United States Patent [19]

Raasch

[11] Patent Number: 4,572,447

[45] Date of Patent: Feb. 25, 1986

[54] DOUBLE-SIDED TEXTILE MACHINE

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 648,895

[22] Filed: Sep. 10, 1984

[30] Foreign Application Priority Data

Sep. 8, 1983 [DE] Fed. Rep. of Germany ..... 3332409

[51] Int. Cl.[4] ..... B65H 54/20; B65H 67/06

[52] U.S. Cl. ..... 242/35.5 A; 193/35 S; 198/457; 198/787

[58] Field of Search ..... 242/35.5 A, 35.5 R, 242/35.6 R; 198/457, 580, 611, 339, 787, 951; 193/35 R, 35 S, 37

[56] References Cited

U.S. PATENT DOCUMENTS

| | | | |
|---|---|---|---|
| 790,776 | 5/1905 | Alvey | 193/35 S |
| 1,287,170 | 12/1918 | Younkman | 193/35 S |
| 3,189,161 | 6/1965 | Schneider et al. | 198/787 |
| 3,369,646 | 2/1968 | Musser | 198/787 |
| 3,724,643 | 4/1973 | Kohl | 198/787 |
| 4,496,110 | 1/1985 | Raasch et al. | 242/35.5 A |

*Primary Examiner*—Stanley N. Gilreath

*Attorney, Agent, or Firm*—Herbert L. Lerner; Laurence A. Greenberg

[57] ABSTRACT

A double-sided textile machine, includes a plurality of bobbin assemblies between first and second ends of the textile machine for producing cross-wound bobbins; a device for collecting and transporting the bobbins produced in the bobbin assemblies, including a bobbin collection station in vicinity of the first end of the machine, a first bobbin transport belt for receiving bobbins axially aligned in a first transport direction from a first side of the machine and for moving the bobbins toward the collection station in the first transport direction, a second bobbin transport belt similar to the first transport belt for receiving bobbins axially aligned in a second transport direction opposite the first transport direction from a second side of the machine and for moving the bobbins away from the collection station in the second transport direction, a substantially semicircular device in vicinity of the second end of the machine for sequentially removing bobbins from the second transport belt, for turning the bobbins through substantially 180° and for transporting the bobbins onto the first transport belt, the substantially semicircular device including a roller conveyor having tapered rollers accelerating the bobbins.

14 Claims, 4 Drawing Figures

DOUBLE-SIDED TEXTILE MACHINE

The invention relates to a double-sided textile machine including a plurality of bobbin assemblies for producing cheeses or cross-wound bobbins, a device for collecting and transporting the cheeses which have been produced, the collecting and transporting device being formed of a bobbin collection station at the head end of the machine, a bobbin transport belt which moves toward the bobbin collection station for receiving the cheeses which are aligned axially in the transport direction at one side of the machine, and a similarly constructed bobbin-transport belt which runs in the opposite direction at the other side of the machine, and a device for the sequential removal of the cheeses from the transport belt, for turning the cheeses 180° and for transferring the cheeses onto the bobbin transport belt which runs toward the bobbin collection station, the device being semicircular, being disposed at the end of the two bobbin-transport belts which faces away from the bobbin collection station, and being provided with a roller conveyor formed of tapered rollers.

Heretofore, cross-wound bobbins or cheeses which had been produced were either removed manually or by machine, without giving special attention to the position occupied by the bobbins in space during their manufacture. When the cheeses were later used, difficulties were encountered because one cannot easily visually tell if thread is to be unwound clockwise or counterwise from a cylindrical cross-wound bobbin.

For this reason, if the thread is subsequently unwound over head, difficulties can arise, and errors occur during the production of flat patterns. This is because some of the cheeses are incorrectly mounted in a bobbin frame, and are unwound over head with the wrong rotational sense.

It was recognized that these difficulties could only be overcome if this mixup of the original winding position and winding sense of the cheeses was prevented at the double-sided textile machine which produced the cheeses. In order to correct this situation, the device for collecting and removing the cheeses which have been produced is formed of a bobbin collection station at the head end of the machine, a bobbin transport belt which moves toward the bobbin collection station for receiving the cheeses which are aligned axially in the transport direction at one side of the machine, and a similarly constructed bobbin transport belt running in the opposite direction disposed at the other side of the machine, a device is provided for the sequential removal of the cheeses from the transport belt, for turning the cheeses 180°, and for transferring them onto the bobbin transport belt which runs toward the bobbin collecting station. This device at the end of the two bobbin transport belts which faces away from the bobbin collection station, is provided with a roller conveyor formed of tapered rollers, which are disposed in a semi-circle.

The following difficulties may arise during the operation of an installation of this type:

The cheeses may be pushed into each other on the curved roller conveyor, they may obstruct each other in their forward motion, and they can jam so that further transport becomes impossible.

The invention is based on the recognition that these difficulties can only be avoided, if the cheeses as they are transferred onto the transport belt which runs in the opposite direction, are moved forward with a greater velocity than the cheeses positioned on the transport belt which supplies the cheeses.

It is accordingly an object of the invention to provide a double-sided textile machine which overcomes the hereinafore-mentioned disadvantages of the heretofore-known devices of this general type, and to make suitable provisions, not only for the cheeses produced at both sides of the textile machine to be delivered orderly and ready for further use at a predetermined place, under consideration of the original winding position and winding sense, but to ensure that no difficulties are caused thereby during the transport of the cheeses.

With the foregoing and other objects in view there is provided, in accordance with the invention, a double-sided textile machine, comprising a plurality of bobbin assemblies between first and second ends of the textile machine for producing cross-wound bobbins; a device for collecting and transporting the bobbins produced in the bobbin assemblies, including a bobbin collection station in vicinity of the first or head end of the machine, a first bobbin transport belt for receiving bobbins axially aligned in a first transport direction from a first side of the machine and for moving the bobbins toward the collection station in the first transport direction, a second bobbin transport belt similar to the first transport belt for receiving bobbins axially aligned in a second transport direction opposite the first transport direction from a second side of the machine and for moving the bobbins away from the collection station in the second transport direction, a substantially semicircular device disposed at the end of the two transport belts in vicinity of the second end of the machine facing away from the bobbin collection station for sequentially removing bobbins from the second transport belt, for turning the bobbins through substantially 180° and for transporting the bobbins onto the first transport belt, the substantially semicircular device including a roller conveyor having tapered rollers accelerating the bobbins.

In accordance with another feature of the invention, the semicircular device moves the bobbins in a third transport direction, the roller conveyor is in the shape of a winding staircase, and the tapered rollers have individual bearings and a generatrix line from roller to roller at which the bobbins are supported, the generatrix line being vertically lower stepwise as seen in the third transport direction. In this case the cheeses are accelerated by gravitation.

In accordance with a further feature of the invention, the semicircular device includes a drive unit for the tapered rollers.

In accordance with an added feature of the invention, the drive unit includes a bevel or crown wheel having a rim in frictional contact with the tapered rollers.

In accordance with an additional feature of the invention, the bevel wheel is disposed below the roller conveyer. In this way the upper side of the rollers is left free to transport the cheeses.

In accordance with again another feature of the invention, the tapered rollers rest on the bevel wheel.

In accordance with again a further feature of the invention, there is provided a spacer ring surrounded by the bevel wheel, the tapered rollers having the smaller ends thereof disposed on and carried by the rim, and the tapered rollers having journal pinions engaged in holes formed in the spacer ring.

In accordance with again an added feature of the invention, the spacer ring is variable in height and is non-rotatably supported.

In accordance with again an additional feature of the invention, there is provided another bevel wheel above the tapered rollers having a rim disposed on the small ends of the tapered rollers, for applying a load.

In accordance with yet another feature of the invention, there is provided at least one spiral spring loading the other bevel wheel.

In accordance with a concomitant feature of the invention, there are provided journal pins disposed at the larger ends of the tapered rollers and bearings supporting the journal pins, the journal pins being disposed along a geodetic line deviating upward at an initial portion thereof from a circle and returning to a circle at another portion thereof. This is done in order to counteract centrifugal force and to improve the transport of the cheeses. This provision makes it possible to place the supporting generatrix line of the first and last tapered roller of the conveyor at the height of the adjacent bobbin transport belt, while the supporting generatrix lines of all of the other tapered rollers are raised from the horizontal plane toward the outside. The cheeses moving along the circle are therefore pushed toward the center point of the circular travel without an abrupt jump in height anywhere on the traveled track.

Other features which are considered as characteristic for the invention are set forth in the appended claims.

Although the invention is illustrated and described herein as embodied in a double-sided textile machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
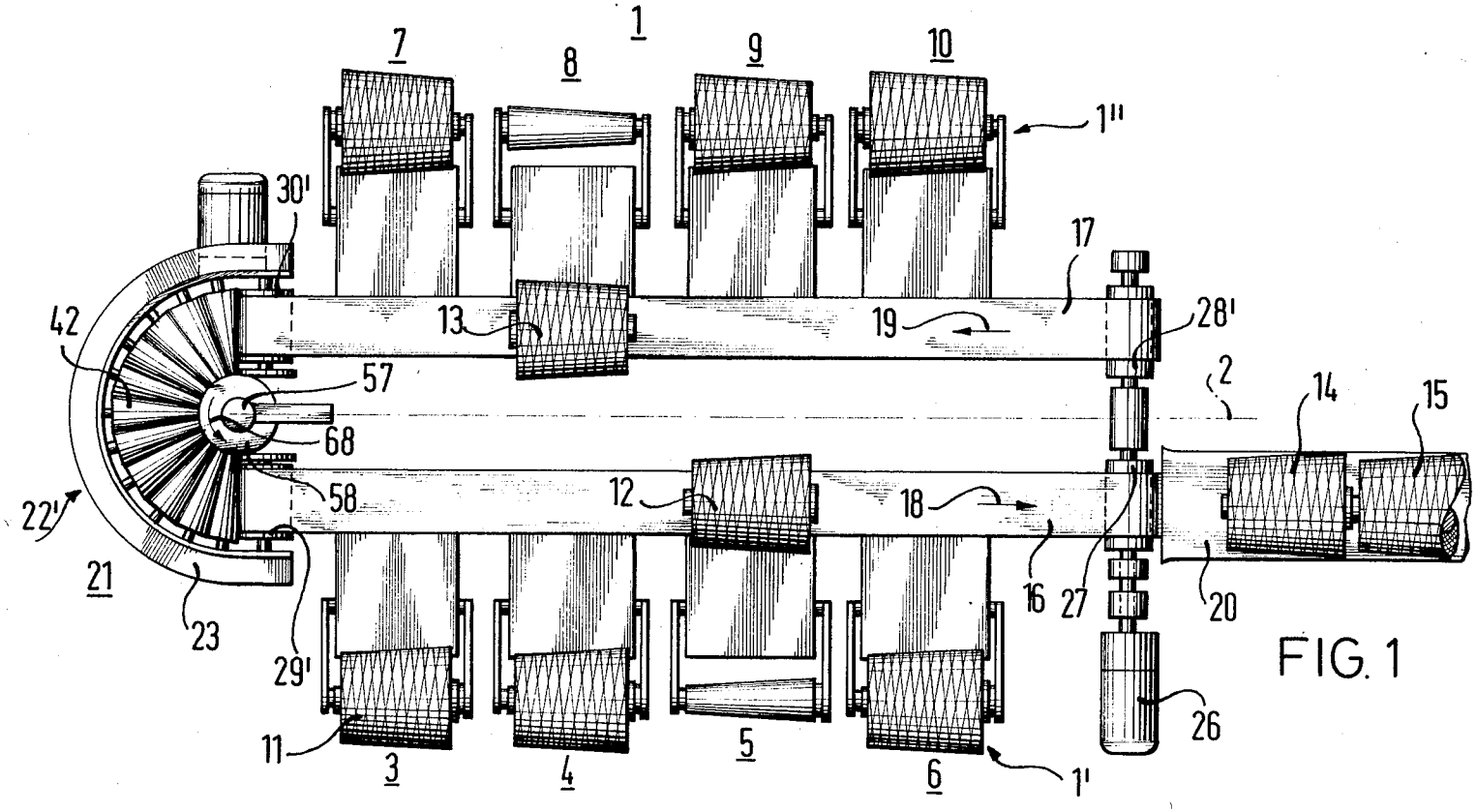
FIG. 1 is a diagrammatic top-plan view of a double-sided texile machine.

Referring now to the figures of the drawings in detail and first particularly to FIG. 1 thereof, there is seen a double-sided textile machine 1 representing an open end spinning machine. The open end spinning machine 1 includes machine sides 1' and 1''. The plane separating the two sides of the machine is designated with reference numeral 2. In FIG. 1 bobbin assemblies 3 to 6 are on the machine side 1', and bobbin assemblies 7 to 10 are on the machine side 1''. At the point in time represented in the drawing, the bobbin assemblies 3, 4, 6, 7, 9 and 10 are winding conical cheeses or cross-wound bobbins. The cheese designated with reference numeral 11, shown in bobbin station 3, is representative of all of the other conical cheeses. Bobbin station 5 has just deposited a conical cheese 12 onto a bobbin conveyor 16 with the axis of the cheese aligned in the transport direction. The transport direction is indicated by an arrow 18. The bobbin conveyor belt 16 ends at a bobbin collection station 20 which already contains two conical cheeses 14 and 15. Bobbin station 8 has just deposited its cross wound bobbin or cheese 13 onto a conveyor belt 17 having a transport direction which is indicated by an arrow 19. The two bobbin conveyor belts run in opposing directions.

At the left head end of the textile machine 1, a device 21 is provided which serves for the sequential removal of the cheeses 13 from the bobbin conveying belt 17, for turning the bobbins 180° and for transferring these cheeses onto the other bobbin conveying belt 16, which moves toward the bobbin collecting station 20. The device 21 includes a semicircular roller conveyor 22' formed of conical rollers 42, which are surrounded by semicircular guide surfaces 23.

The axis of the semicircular conveyor 22' is disposed between the conveyor belts 16 and 17. Both conveyor belts 16 and 17 have a common drive 26. This drive 26 is constructed in the form of a geared motor. The bobbin conveyor belt 26 is provided at the end thereof with a drive roller 27 which is connected with the drive 26. The other bobbin conveyor belt 17 is driven by an additional drive roller 28'. Additionally, the bobbin conveying belts wrap around deflection rollers 29' and 30'.

The device 21 which serves for accelerating the cheeses also has a drive unit which is designated with reference numeral 43 as a whole. According to FIG. 2, the drive unit 43 includes an axle-drive bevel wheel or spur bevel gear 44 having a rim 45 which makes frictional contact with the tapered or conical rollers 42 from below. The tapered rollers 42 rest with their small ends on the rim of the bevel wheel 44, and in this way are supported or carried by the bevel wheel 44. Journal pins 46 which are also disposed at the small end of the tapered rollers 42 engage in suitable holes formed in a spacer ring 47.

The bevel wheel 44 is keyed to a vertical shaft 48 which is supported in a bearing 49. The shaft 48 carries a bevel gear 50 at its lower end which meshes with a bevel gear 51. The bevel gear 52 sits on the horizontal shaft of a drive motor 52.

Figure 2:
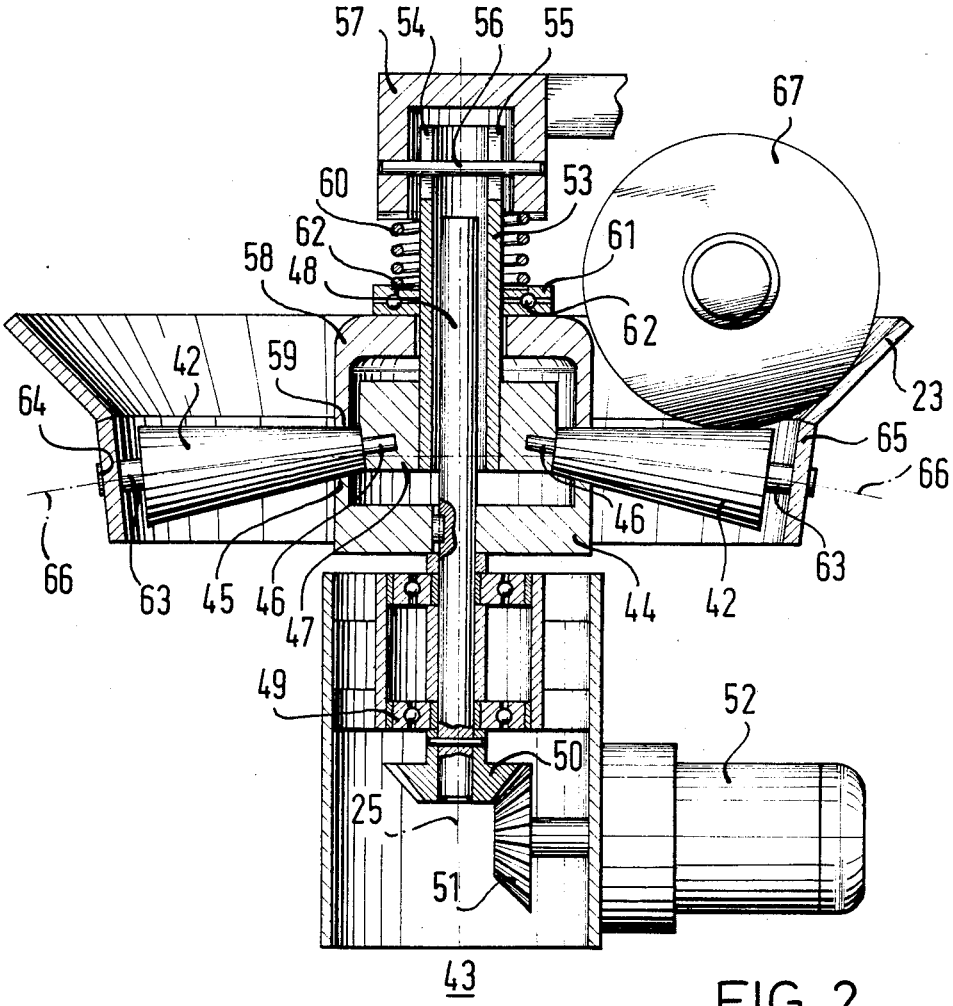
FIG. 2 is a fragmentary cross-sectional view of the roller conveyor of the embodiment according to FIG. 1.

FIG. 2 shows that the vertical shaft 48 serves for guiding and centering a sleeve 53 which is connected to the spacer ring 47. The sleeve 53 serves the function of supporting the spacer ring 47 in such a way that its height is variable, but it cannot rotate with respect to the journal pins 46 of the tapered rollers 42. For this purpose, the sleeve 53 has two slots 54 and 55 at its upper end which are covered by a stationarily positioned cap 57. A horizontal guide pin 56 extends through the cap 57, and the two slots 54 and 55, so that the sleeve 53 cannot rotate about an axis 25.

Another axle-drive bevel wheel 58 is disposed above the tapered rollers 42, serving as a loading wheel for applying a load onto the tapered rollers 42. The rim of the bevel wheel 58 rests on the small ends of the tapered rollers 42. The bevel or load applying wheel 58 is itself loaded by a spiral spring 60. The upper end of the spiral spring is retained in a recess formed in the cap 57, and the lower end of the spring is supported in a groove formed in the upper ring 61 of a thrust bearing 62.

Journal pins 63 in the larger ends of the tapered rollers 42 are supported in suitable bearings 64 which are disposed in a semicircular wall 65. The wall 65 is stationarily positioned, and blends into the bobbin guide surface 23 at the top thereof. The bearings 64 are disposed along a geodetical line 66 which first deviates upward from a circle and then returns again to a circle. The geodetical line 66 is indicated in a side view in FIG. 2. The effect of this construction is that the first horizontal mantle or shell surface which carries the bobbins ascends more and more progressing from roller to roller and then returns again to a horizontal orientation. Because of this disposition of the bearings 64, the bobbins 67 which are traveling in a circle, are caused to lean against the bevel wheel 58, so that they are transported not only by the tapered rollers 42, but also by the upper back or ridge of the bevel wheel 58 as well.

With the drive 26 operating, the two bobbin transport belts 16, 17 run in the transport directions indicated by the arrows 18, 19. At the same time, the bevel wheel 58 rotates in the direction of the curved arrow 68. All of the conical cheeses deposited onto the bobbin transport belts are transported with their wider conical ends leading in the direction toward the bobbin collection station 20. For instance, the conical cheese 13 reaches the roller conveyor 22',. is grasped by the rotating tapered rollers 42 and is carried along in the direction of the arrow 68.

The cheeses deposited onto both bobbin transport belts are either continously moved to the bobbin collection station 20, or the belts serve as intermediate storage locations from time to time. An intermediate storage function is of advantage, for instance, if the bobbon collection station 20 is only suitable for discontinuous or intermittent use. For example, the bobbin collection station could be a traveling bobbin storage device. The bobbin transport belts may be controlled by the bobbin collection station. The automatic bobbin deposition onto the bobbin transport belts may also be blocked during the time that the belts are moving. This is conceivable for a discontinuous operation wherein the transport belts can be completely emptied rapidly.

Figure 4:
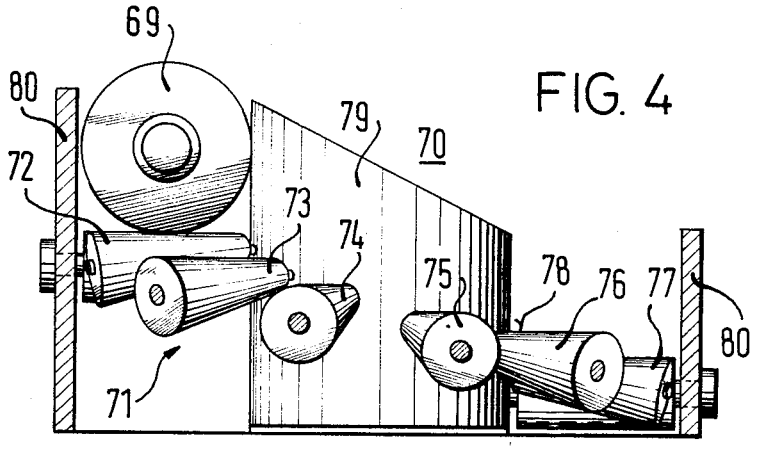
FIG. 4 is a side-elevational view of the roller conveyor according to FIG. 3.
Figure 3:
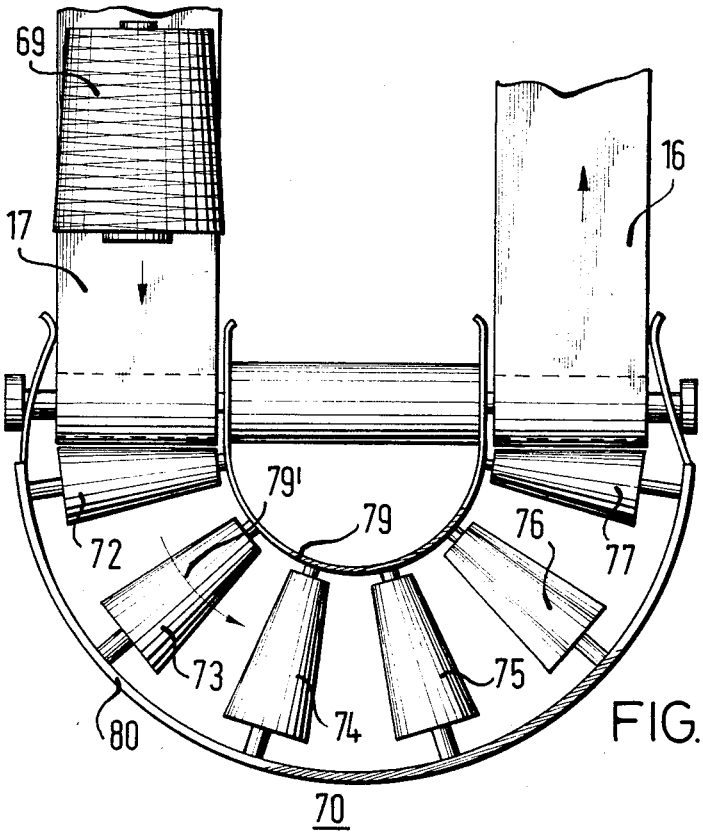
FIG. 3 is a fragmentary top-plan view of an alternate version of the roller conveyor.

In FIGS. 3 and 4, a device 70 is shown which is more simply constructed than the device 21 described above for accelerating the cheeses, such as a just arriving cheese 69. The device 70 is formed of a winding staircase-type roller conveyor 71, in conjunction with the individual placement of bearings of individual tapered rollers 72 to 77. This is done in such a way that a generatrix or surface line 78 carrying the cheeses from tapered roller to tapered roller is at a lower level from step to step, as seen in the transport direction 79'. This is clearly shown in FIG. 4. In this case, the individual drive of the tapered rollers can be omitted. As the cheese 69 is moved by the bobbin transport belt 17 with its center of gravity beyond the tapered roller 72, it tilts forward under the influence of gravity, and is accelerated by gravitation. The traveling speed of the cheese therefore increases until it reaches the bobbin transport belt 16 which is positioned somewhat lower, and is moved on further by the belt 16. During its circular travel, lateral guiding guards 79 and 80 prevent the cheeses which are being transported from falling off or tilting.

It is advantageous to construct the device which accelerates the cheeses in such a way that the cheeses reach a velocity during their circular travel which remains as high or higher than the velocity of the transport belt which brings the cheeses to the device. For example, driven tapered rollers which are at the point where they contact the cheeses, can have a peripheral velocity equal to or greater than the velocity of the bobbin transport belt.

The invention is not limited to the illustrated and described specific embodiments used as examples.

I claim:

1. Double-sided textile machine, comprising a plurality of bobbin assemblies between first and second ends of the textile machine for producing cross-wound bobbins; a device for collecting and transporting the bobbins produced in the bobbin assemblies, including a bobbin collection station in vicinity of said first end of the machine, a first bobbin transport belt for receiving bobbins axially aligned in a first transport direction from a first side of the machine and for moving the bobbins toward said collection station in said first transport direction, a second bobbin transport belt similar to said first transport belt for receiving bobbins axially aligned in a second transport direction opposite said first transport direction from a second side of the machine and for moving the bobbins away from said collection station in said second transport direction, a substantially semicircular device disposed in vicinity of said second end of the machine for sequentially removing bobbins from said second transport belt, for turning the bobbins through substantially 180° and for transporting the bobbins onto said first transport belt, said substantially semicircular device including a roller conveyer having tapered rollers accelerating the bobbins.

2. Double-sided textile machine according to claim 1, wherein said semicircular device moves the bobbins in a third transport direction, said roller conveyor is in the shape of a winding staircase, and said tapered rollers have individual bearings and a generatrix line from roller to roller at which the bobbins are supported, said generatrix line being vertically lower stepwise as seen in said third transport direction.

3. Double-sided textile machine according to claim 1, wherein said semicircular drive includes a drive unit for the tapered rollers.

4. Double-sided textile machine according to claim 3, wherein said drive unit includes a bevel wheel having a rim in frictional contact with said tapered rollers.

5. Double-sided textile machine according to claim 4, wherein said bevel wheel is disposed below said roller conveyor.

6. Double-sided textile machine according to claim 4, wherein said tapered rollers rest on said bevel wheel.

7. Double-sided textile machine according to claim 4, including a spacer ring surrounded by said bevel wheel, said tapered rollers having the smaller ends thereof disposed on and carried by said rim, and said tapered rollers having journal pinions engaged in holes formed in said spacer ring.

8. Double-sided textile machine according to claim 7, wherein said spacer ring is variable in height and is non-rotatably supported.

9. Double-sided textile machine according to claim 5, including another bevel wheel above said tapered rollers having a rim disposed on the small ends of said tapered rollers, for applying a load.

10. Double-sided textile machine according to claim 7, including another bevel wheel above said tapered rollers having a rim disposed on the small ends of said tapered rollers, for applying a load.

11. Double-sided textile machine according to claim 9, including at least one spiral spring loading said other bevel wheel.

12. Double-sided textile machine according to claim 10, including at least one spiral spring loading said other bevel wheel.

13. Double-sided textile machine according to claim 3, including journal pins disposed at the larger ends of the tapered rollers and bearings supporting said journal pins, said journal pins being disposed along a geodetic line deviating upward at an initial portion thereof from a circle and returning to a circle at another portion thereof.

14. Double-sided textile machine according to claim 7, including journal pins disposed at the larger ends of the tapered rollers and bearings supporting said journal pins, said journal pins being disposed along a geodetic line deviating upward at an initial portion thereof from a circle and returning to a circle at another portion thereof.

* * * * *